US006469619B1

(12) United States Patent
Mayercheck et al.

(10) Patent No.: US 6,469,619 B1
(45) Date of Patent: Oct. 22, 2002

(54) INTRINSICALLY-SAFE ROOF HAZARD ALERT MODULE

(75) Inventors: William D. Mayercheck, Harrison City, PA (US); Albert L. Brautigam, Pittsburgh, PA (US)

(73) Assignee: The United States of America as represented by the Department of Health and Human Services, Washington, DC (US)

( * ) Notice: Subject to any disclaimer, the term of this patent is extended or adjusted under 35 U.S.C. 154(b) by 0 days.

(21) Appl. No.: 09/673,595

(22) PCT Filed: Apr. 20, 1999

(86) PCT No.: PCT/US99/08613

§ 371 (c)(1),
(2), (4) Date: Dec. 15, 2000

(87) PCT Pub. No.: WO99/56258

PCT Pub. Date: Nov. 4, 1999

(51) Int. Cl.[7] ..... N01N 37/36

(52) U.S. Cl. ..... 340/331; 340/321; 340/953; 340/691; 340/825.34; 340/825.44; 340/573.1

(58) Field of Search ..... 340/331, 321, 340/953, 691, 825.34, 825.44, 573.1

(56) References Cited

U.S. PATENT DOCUMENTS

| | | | |
|---|---|---|---|
| 1,429,211 A | 9/1922 | Lightburn | |
| 4,103,298 A | 7/1978 | Redding | 340/331 |
| 4,164,539 A | 8/1979 | Johnston | 422/95 |

(List continued on next page.)

FOREIGN PATENT DOCUMENTS

| | | |
|---|---|---|
| BE | 876198 | 12/1979 |
| FR | 1522038 | 5/1967 |

OTHER PUBLICATIONS

Signer, Steve, "Methods for the Prevention of Mine Roof Support Failure," Apr. 23, 1998, www.cdc.gov/niosh/pit/failure.html, 3 pages.

Blignaut, J. A., Abstract of ZA 903001, "Intrinsically safe power supply—controls output current of battery using sensor and solid state switch," Jan. 30, 1991.

(List continued on next page.)

*Primary Examiner*—Jeffery Hofbass
*Assistant Examiner*—Tai T. Nguyen
(74) *Attorney, Agent, or Firm*—Klarquist Sparkman, LLP

(57) ABSTRACT

A light weight, self-contained, portable, intrinsically-safe warning device for providing warning to personnel of an unsafe condition is provided. This warning device is especially adapted for attachment to the roof of a mine to indicate unsupported roof conditions or other unsafe conditions. This intrinsically-safe warning device has (a) a case having side walls, a first end wall, and second end wall wherein the case has an internal cavity formed by the side walls and first and second end walls; (b) a low-voltage power supply within the case comprising one or more direct current batteries; (c) a switch in electrical contact with the low-voltage power supply to activate the module; (d) a light-emitting diode in electrical contact with the switch and the low-voltage power supply, and (e) a means to attach the module in close proximity to or in a hazard area having a potential hazard such that the light is directed towards the area from which personnel are likely to enter the hazard area, wherein the module is lightweight, portable, and intrinsically-safe; whereby, when the module is activated, the light-emitting diode emits a light to warn personnel in the area of the potential hazard and direct their attention to the potential hazard. This device is especially useful in underground mining operations in order to discourage miners from going into unsupported mine roof areas by rendering the attendant hazard more evident, directing the miner's attention to an appropriate warning message on the device, and thus avoiding the hazard beyond the device.

17 Claims, 3 Drawing Sheets

U.S. PATENT DOCUMENTS

| | | | | | |
|---|---|---|---|---|---|
| 4,404,549 | A | * | 9/1983 | Berg | 340/574 |
| 4,420,840 | A | | 12/1983 | Livermore | 455/606 |
| 4,426,642 | A | | 1/1984 | Poffenbarger | 340/690 |
| 4,455,509 | A | | 6/1984 | Crum et al. | 315/119 |
| 4,604,706 | A | | 8/1986 | Fisher, Jr. et al. | 364/507 |
| 4,634,936 | A | | 1/1987 | Gentry et al. | 315/307 |
| 4,754,142 | A | | 6/1988 | Cooper et al. | 250/343 |
| 4,881,058 | A | * | 11/1989 | Berry, III | 340/326 |
| 4,992,340 | A | | 2/1991 | Tidwell et al. | 429/7 |
| 5,055,266 | A | | 10/1991 | Stetter et al. | 422/83 |
| 5,231,841 | A | * | 8/1993 | McClelland et al. | 62/77 |
| 5,337,041 | A | * | 8/1994 | Friedman | 340/573 |
| 5,381,321 | A | | 1/1995 | Fearing, Jr. et al. | 362/217 |
| 5,394,094 | A | | 2/1995 | Wagner | 324/556 |
| 5,400,008 | A | * | 3/1995 | Toohey | 340/321 |
| 5,469,002 | A | | 11/1995 | Garrett | 307/150 |
| 5,534,664 | A | | 7/1996 | Fearing, Jr. et al. | 174/50 |
| 5,585,783 | A | | 12/1996 | Hall | 340/473 |
| 5,729,215 | A | * | 3/1998 | Jutras | 340/908.1 |
| 6,003,257 | A | * | 12/1999 | Stokes | 40/610 |
| 6,069,557 | A | * | 5/2000 | Anglin, Jr. et al. | 340/321 |
| 6,174,070 | B1 | * | 1/2001 | Takamura et al. | 362/183 |

OTHER PUBLICATIONS

Mallett, C.W. et al., Abstract of "Roof strata alert monitoring," National Energy Research, Dec. 1990.

Birenberg, I. Eh. et al., Abstract of, "New signalling device for methane monitoring in coal mines," Bezop. Tr. Prom–sti. (USSR), Sep. 1985.

*Technology News*, NIOSH, "Roof Hazard Alert Modules," U.S. Department of Health and Human Services, Public Health Service, Centers for Disease Control and Prevention, National Institute for Occupational Safety and Health, May, 1997, No. 455, 2 pages.

* cited by examiner

INTRINSICALLY-SAFE ROOF HAZARD ALERT MODULE

FIELD OF THE INVENTION

The present invention relates generally to an intrinsically-safe warning device for providing warning to personnel of an unsafe condition. More specifically, the present invention relates to an intrinsically-safe roof hazard warning device designed to be attached to the roof of a mine to indicate unsupported roof conditions or other unsafe conditions. The device of this invention is especially useful in underground mining operations.

BACKGROUND OF THE INVENTION

Underground mines potentially present many hazards to miners and other workers. Such hazards include, for example, confined spaces, falling rock or substrate from side walls and roof structures, potentially explosive atmospheres (e.g., methane and/or coal dust), heavy equipment, and the like. For example, during mining operations, roof bolts are used to support and maintain the stability of the roof system. Nonetheless, during expansion of such mining areas and perhaps at other times, the area beyond the last installed roof bolts or support systems remains unsupported and, thus, potentially unstable and hazardous. Miners or other personnel venturing (unknowingly or otherwise) into such unsupported areas (i.e., beyond the last row of roof bolts) are exposed to hazardous conditions associated with the potentially unstable roof structure. Moreover, during cutting into mine areas the risk of potentially explosive or hazardous conditions may be particularly high since the newly-opened mine shaft may intersect gas pockets or other concentrated gaseous areas or create high dust levels or may intersect areas with particularly weak overburden.

It would be desirable, therefor, to provide intrinsically-safe warning devices that render the attendant hazard associated with unsupported roof conditions or other hazards more evident. It would also be desirable to provide intrinsically-safe warning devices which direct a person's attention to read the appropriate warning message on the device and, therefore, make the person more likely to comply with the warning and avoid the hazard. It would also be desirable to provide intrinsically-safe warning devices which are inexpensive, self-contained, reliable, portable, easily installed, easily relocated, and easily removed. Such devices would be ideally suited for warning temporary or short-term hazardous conditions. The present invention provide such intrinsically safe warning devices. These devices represent an engineering intervention strategy especially adapted toward improving miners' ability to recognize and avoid the hazardous zone of unsupported mine roofs.

SUMMARY OF THE INVENTION

The present invention relates generally to an intrinsically-safe warning device for providing warning to personnel of an unsafe condition. More specifically, the present invention relates to an intrinsically-safe roof hazard warning device designed to be attached to the roof of a mine to indicate unsupported roof conditions or other unsafe conditions. The device of this invention is especially useful in underground mining operations in order to discourage miners from going into unsupported mine roof areas by rendering the attendant hazard more evident, directing the miner's attention to an appropriate warning message on the module, and thus avoiding the hazard beyond the device.

The warning device of this invention is intrinsically-safe, self-contained, simple to use, inexpensive to build and operate, portable, light weight, compact, and low-profile. These features make it especially useful as a warning device in short-term or temporary hazardous situations where the installation of complex and/or bulky warning systems may not be warranted or justified. Since the present warning device is intrinsically-safe, it can be used in a variety of mining environments (including gassy mining environments). By providing an inexpensive, readily portable, and easily installed (as well as easily removed) system, compliance will likely be significantly improved.

One object of the present invention is to provide an intrinsically-safe hazard alert module for warning personnel of a potential hazard, said module comprising (a) a case having side walls, a first end wall, and second end wall wherein the case has an internal cavity formed by the side walls and first and second end walls; (b) a low-voltage power supply within the case comprising one or more direct current batteries; (c) a switch in electrical contact with the low-voltage power supply to activate the module; (d) a light-emitting diode in electrical contact with the switch and the low-voltage power supply; and (e) a means to attach the module in close proximity to or in a hazard area having a potential hazard such that the light is directed towards the area from which personnel are likely to enter the hazard area; wherein the module is lightweight, portable, and intrinsically-safe; whereby, when the module is activated, the light-emitting diode emits a light to warn personnel in the area of the potential hazard and direct their attention to the potential hazard. The intrinsically-safe hazard alert module of this invention is especially adapted for use in mining applications such as, for example, warning of unsupported roof structures past the last installed roof bolts. In such case, the modules can be directly attached or hung from one or more of the last installed roof bolts to warn against entry into the unsupported areas. Once additional roof bolts have been installed, the old modules (with new batteries if appropriate) or new fully charged modules can be moved to the new last installed roof bolts to provide warning against entry into the new unsupported areas.

These and other features and advantages of the present invention will become apparent to those skilled in the art upon a reading of the following detailed description when taken in conjunction with the drawings wherein there is shown and described a preferred embodiment of the invention.

DETAILED DESCRIPTION OF THE PREFERRED EMBODIMENTS

The present invention provides an intrinsically-safe warning device for providing warning to personnel of an unsafe condition. In an especially preferred embodiment, the present invention provides an intrinsically-safe roof hazard warning device designed to be attached to the roof of a mine to indicate unsupported roof conditions or other unsafe conditions. The device of this invention is especially useful in underground mining operations or other environments where potentially explosive gases and/or dusts may be present.

For purposes of this invention, the term "intrinsically-safe" as applied to the module and its electrical circuit is intended to mean that any electrical sparking which may occur during normal working conditions is incapable of igniting a flammable gas or vapor (e.g., 5 to 15 volume percent methane in air). In other words, to be "intrinsically-safe" a device or circuit must have both electrical energy (e.g., resistance, capacitance, and inductance) and thermal energy at levels below that required to ignite a specific hazardous atmosphere (e.g., 5 to 15 volume percent methane in air). Although the device (and its electric circuit) may be sealed against entry of the potentially explosive atmosphere, entry of that atmosphere through failure of the seals, mechanical damage to the device or seals, or the like which allows the potentially explosive atmosphere to contact the electrical circuit would not result in ignition. An intrinsically-safe design is distinguished from an "explosion-proof" design in that, in an explosion-proof device, the potentially explosive atmosphere is prevented from contacting the electrical circuit but, in the event of some failure of the containment system whereby the potentially explosive atmosphere did contact the electrical system, the possibility of ignition would exist. Thus, the present intrinsically-safe hazard alert module employs a light-emitting diode rather than, for example, an incandescent bulb (which might be suitable for an explosion-proof device) since, should the glass portion of such an incandescent bulb break, an ignition source (i.e., thermal energy of the filament) would be present. The light-emitting diode of the present intrinsically-safe hazard alert module, even if broken during operation, would not present such an explosion hazard.

Figure 1:
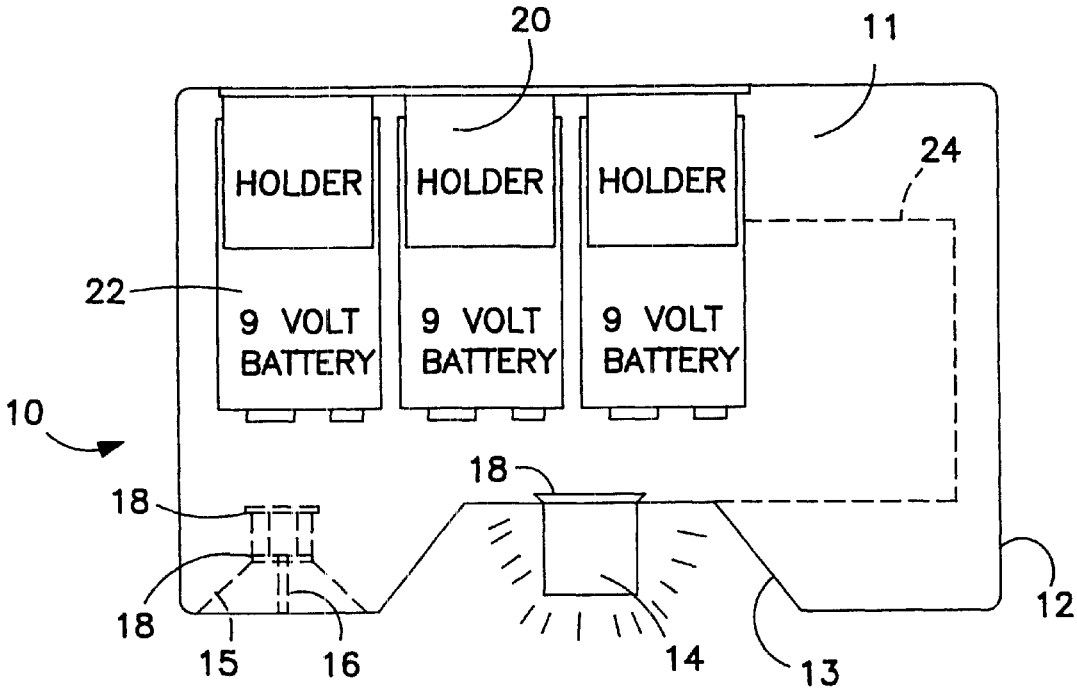
FIG. 1 illustrates one embodiment of the intrinsically-safe hazard alert module showing possible locations for the switch, light, and batteries within the case.

FIG. 1 illustrates an intrinsically-safe hazard alert module 10 of the present invention. The module 10 has a case with an interior cavity 11 formed by the side walls 12 and the first and second end walls (not specifically shown). Located within the cavity 11 is the low-voltage power supply consisting three 9 V direct current batteries 22 in battery holders 20. The on-off switch 16 is located in a first recessed portion 15 of side wall 12. The light-emitting diode 14 is also located in a second recessed portion 13 of side wall 12. Preferably the light-emitting diode 14 is of the flashing type. Use of a flashing-type light-emitting diode increases both the visibility of the device as well as the battery life. Preferably the light-emitting diode 14 flashes at a rate of about 1 to 5 flashes or pulses per second. Preferably the light-emitting diode 14 has a brightly colored lens (e.g., red or caution yellow) in order to increase visibility.

O-rings 18 can be used to seal openings in side wall 12 for the switch 16 and light emitting diode 14. Locating the switch 16 in such a recess reduces the likelihood of accidentally switching off the device as well as providing additional protection for the switch. Locating the light-emitting diode 14 in such a recess provides additional protection for the light source. Of course, as one skilled in the art will realize, the surfaces of recess 13 could be coated with a light-reflecting material to enhance the effect of the light source during operation. Circuit board 24 can be used to form the circuit between the low-voltage power source (i.e., batteries 22), the switch 16, and the light-emitting diode 14.

Figure 2A:
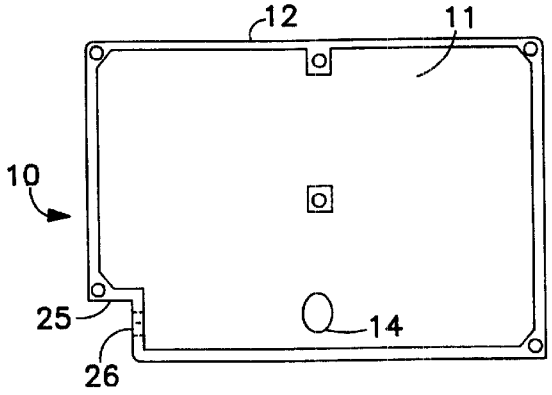
FIG. 2 illustrates a preferred embodiment of the intrinsically-safe hazard alert module showing front and side view of the case and a side view of the cover plate. This embodiment is especially adapted for use as a roof hazard alert module in underground mining operations.
Figure 2B:
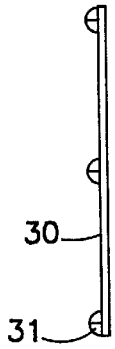
Figure 2C:
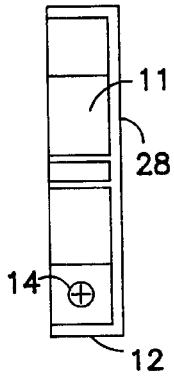
Figure 3A:
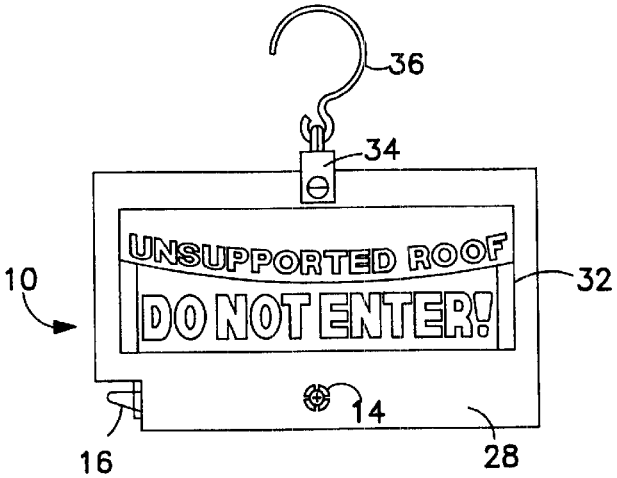
FIG. 3 illustrates the assembled intrinsically-safe hazard alert module of FIG. 2 in front and side views.
Figure 3B:
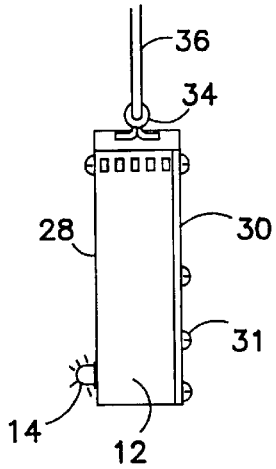

FIGS. 2 and 3 illustrate an intrinsically-safe hazard alert module 10 which is specifically designed to warn personnel of unsupported roof structures in an underground mine. The internal cavity 11 is formed in module 10 by the side walls 12 (FIG. 2A), first end wall 28 (i.e., front end wall; FIGS. 2C and 3B), and second end wall 30 (i.e., back end wall, FIGS. 2B and 3B). The first end wall 28 and the side walls can be integral (as shown in FIG. 2C) or separate components. The second end wall 30 is preferably removable to allow for easy replacement of batteries and/or other repair. The removable second end wall 30 can be attached to the module 10 via screws 31 (threaded portion not shown) or equivalent attachment devices known to the art. It is generally preferred that all openings (including those for the switch 16 and the light-emitting diode 14) and the removable second end wall 30 be sealed against moisture and dust. Sealing can be accomplished using conventional techniques (e.g., O-rings, pre-formed or formed-in-place gaskets, and the like).

The switch 16 is attached to the module 10 through opening 26 in side wall 12. The switch 16 is located in notch 25 to afford protection against accidental shut off and/or accidental damage. The light emitting diode 14 is located on the first end wall 28. As noted above, the light-emitting diode 14 is preferably of the flashing type. Use of a flashing-type diode increases both the visibility of the device as well as the battery life. Preferably the light-emitting diode 14 flashes at a rate of about 1 to 5 flashes or pulses per second. Preferably the light-emitting diode 14 has a brightly colored lens (e.g., red or caution yellow) in order to increase visibility. Located directly above the light emitting diode 14 and also on the first end wall 28 is warning decal 32. Preferably the warning decal 32 is constructed of light reflecting material to enhance its visibility. As one of ordinary skill in the art will realize, the actual warning on the decal 32 can be varied depending on the intended use (i.e., the hazard for which the warning is to be issued). The warning decal 32 in FIG. 3A is, of course, specifically for a roof hazard alert module to warn miners and other personnel from entering unsupported roof areas.

In operation, the intrinsically-safe roof hazard alert module 10 of FIG. 3 (or modules) can be attached, for example, to the last installed roof bolt or line of roof bolts (i.e., just before the beginning of the unsupported roof area) via hook 36 which is attached to the module 10 through clasp or attachment 34. Preferably, the hook 36 and clasp 34 can be rotated such that the light-emitting diode can be directed towards the direction in which personnel will approach the potential hazard. Of course. other means of attachment could be used. For example, the module 10 could be attached to a roof bolt via a magnetic device (not shown).

Moreover, the distance from which the module 10 hangs below the roof bolt could be varied to account for different ceiling heights. For example, in high coal seams, module 10 could be extended several feet (or more) from the roof surface; whereas in low coal seams, module 10 could be mounted within a few inches (or even directly on) the roof surface. Indeed, module 10 in FIG. 3A could, if desired and/or necessary, be mounted with the end wall 28 parallel to the roof surface to achieve maximum clearance, of course, in such a case it would be preferred to modify the placement of the warning decal 32 to make it more visible. In general, it is preferred that the module 10 be suspended from the roof at a height where it will be easily visible to personnel in the mine while at the same time allowing for personnel and equipment to pass underneath the module. For example, it is generally preferred that the module (and specifically the light-emitting diode) be about at or just above eye level so as to be easily visible but high enough so as not to significantly impede, for example, placement of additional roof bolts in the unsupported areas. Indeed, by placing the warning modules at heights which allows easy passage of personnel and equipment underneath will encourage leaving the warning modules in place until additional roof bolts are in place. Once the additional roof bolts are in place, the module or modules (with new or recharged batteries if appropriate) can be placed on or attached to the newly installed roof bolts.

As those skilled in the art will realize, the physical dimensions and materials of construction of the intrinsically-safe hazard alert modules of the present invention are not critical so long as the device can serve its intended purpose. Nonetheless, it is generally preferred that the modules are both portable and lightweight. Modules (as illustrated in FIG. 3) generally in the range of about 4 to 7 inches wide, about 3 to 5 inches high, and about ¾ to 2 inches deep are generally preferably. Of course, dimensions larger or smaller may be suitable and even preferred in some specific applications. Generally the case or container (i.e., the side walls 12 and first and second end walls 28 and 30) is a hard and durable material which can withstand the rigors of the mining environment; examples of such materials include, but are not limited to, high-impact plastics, aluminum, brass, steel, and the like. Generally non-sparking aluminum alloys and brass are preferred due to their light weight, strength, and non-sparking characteristics.

Figure 4:
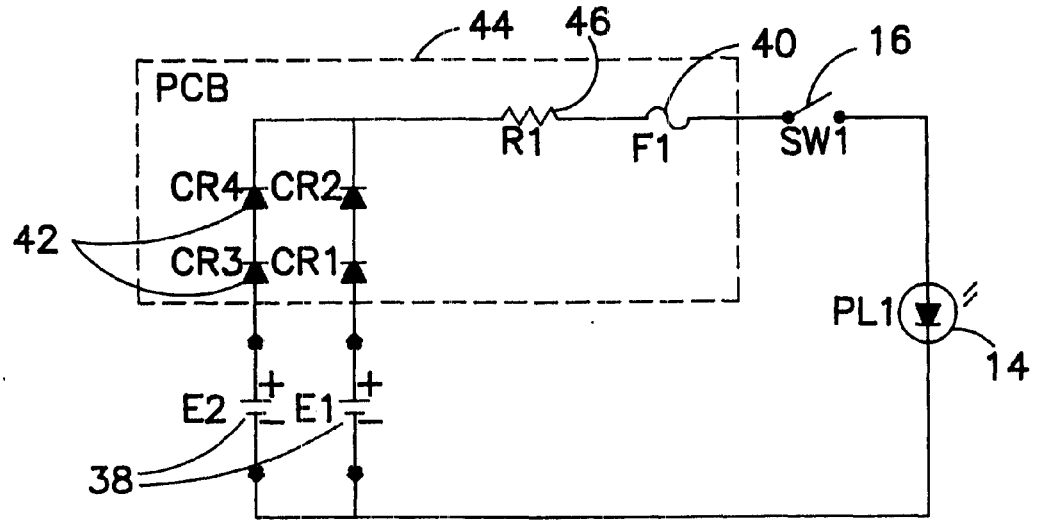
FIGS. 4 and 5 illustrate several circuit diagrams suitable for the intrinsically-safe hazard alert modules of this invention.
Figure 5:
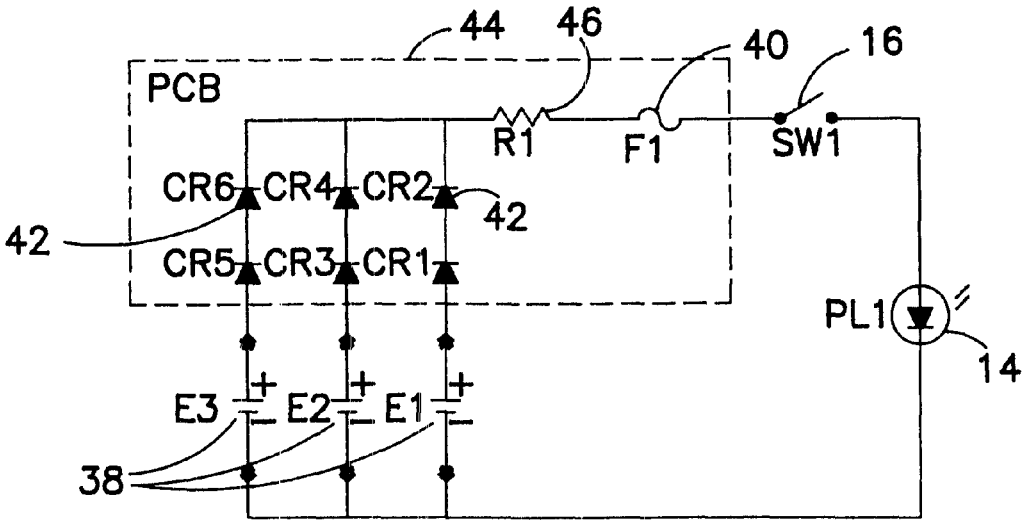

Electrical circuits suitable for use in the intrinsically-safe hazard alert modules of the present invention are shown in FIGS. 4 and 5. Except for portions of the switch 16 and warning light 14, all electrical components are located within cavity 11. FIG. 4 employs two batteries 38 (E1 and E2) in parallel; FIG. 5 employs three batteries 38 (E1, E2, and E3) in parallel. In both cases, the batteries 38 are in electrical contact with switch 16 (SW1) via rectifiers 42 (CR1 through CR4 in FIG. 4 and CR1 through CR6 in FIG. 5), resistor 46 (R1), and fuse 40 (F1). Rectifiers 42, resistor 46, and fuse 40 are preferably located on printed circuit board (PCB) 44. The flashing light-emitting diode 14 (PL1) is located between the switch 16 and the opposite terminal of the batteries 38. Rectifiers 42 are used to limit current flow in one direction, thereby preventing blown light-emitting diodes in case the batteries are inserted incorrectly. Generally it is preferred that two rectifiers 42 be inserted in line with each battery to provide added protection. Again, the specific selection of the electrical components is not critical so long as the selected components can perform their intended functions.

The batteries can be either non-rechargeable (i.e., disposable) or rechargeable. Disposable batteries are generally preferred. Generally the batteries are in the range of about 2 to 10 volts dc. Generally 9 volt dc alkaline (PP3 can type) disposable batteries are preferred. Switch 16 is preferably an on-off toggle type (e.g., model A101MYZQ from Augat/Alcoswitch). Fuse 40 is preferably a fast acting, low-amperage, subminiature type normally rated at about 1/10 to about ¼ amperes (e.g., model 251.125 from Littlefuse rated at ⅛ amperes). Any suitable rectifiers 42 can be used (e.g., IA, 400 volt silicon rectifiers model 1N4004 from Motorola). As noted above, the rectifiers are preferably used in pairs with each battery in the low-voltage power supply to provide redundancy. Any suitable light-emitting diode can be used for the warning light 14. Preferably the warning light is a flasher-type (operating at about 1 to 5 pulses per second) to provide superior warning capabilities. Preferably the warning light also has a brightly colored lens or covering for increased visibility. One preferred indicator or warning light is a red flasher type (about 1.5 to about 2.5 pulses per second) light-emitting diode, model 5100HIFL from Industrial Devices, Inc. The resistor 46 is used to limit the current through the rectifiers 42 to the proper range (generally about 0.75 amperes or less) in the advent of a simultaneous failure of the light-emitting diode 14 and the fuse 40.

Although the modules illustrated herein generally contain only one warning light, one of ordinary skill in the art will realize that more than one such warning light could be mounted on the same or a different surface of the module if desired. For example, the module illustrate in FIG. 3A could, if desired, have more than one light-emitting diode on end wall 28. Likewise, additional light-emitting diodes could be places on end wall 20 or on various locations on side wall 12 to increase the visibility of the device. Likewise, warning decals similar to decal 32 could be placed on other module surfaces if desired.

Although the present intrinsically-safe hazard alert module has been described largely in terms of its use in underground mining applications, especially in unsupported roof applications, those of ordinary skill in the art will readily realize that the present invention can be used in many other situations and environments. The present invention is, of course, especially useful in potentially hazardous atmospheres such as mining, chemical processing facilities, nuclear power plants, dusty areas (metal grinding areas, grain elevators and silos), and the like.

The following example is provided to illustrate the invention and not to limit the invention.

EXAMPLE

Several intrinsically safe roof hazard alert modules were prepared in accordance with the present specification. Generally, these modules were constructed similar to the device illustrated in FIGS. 2 and 3 using the circuit diagrams illustrated in FIGS. 4 and 5. One module (about 5.25×5.25×1.25 inches) constructed with a non-sparking aluminum case was fitted with three 9 volt dc disposable alkaline batteries (corresponding to the circuit diagram in FIG. 5). The non-sparking aluminum was Aluminum Alloy 6061 (low magnesium (about 0.8 to 1.2 weight percent; ASTM B209-86) A flasher-type red light-emitting diode (model 5100HIFL from Industrial Devices, Inc.) with a flash rate of about 1.5 to 2.5 flashes per second was used. The module was fitted with a hook (as shown in FIG. 3 for attachment to a roof bolt. Total weight was about 1.1 pounds. A second module (about 5.25×3.25×1.25 inches) was constructed in a similar manner except it was fitted with only two 9 volt dc disposable alkaline batteries (corresponding to the circuit diagram in FIG. 4) and with a magnetic-type attachment mechanism. Using the same flasher-type red light-emitting diode, it weighed about 1.5 pounds. Both units provided good visibility and warning characteristics. The three-battery model had an estimated battery life of about 487 hours (about 121 shifts at 4 hours per shift); the two-battery model had an estimated battery life of about 360 hours (about 90 shifts at 4 hours per shift)

What is claimed is:

1. An intrinsically-safe hazard alert module for warning personnel of a potential hazard, said module comprising:

(a) a case having side walls, a first end wall, and second end wall wherein the case has an internal cavity formed by the side walls and first and second end walls;

(b) a low-voltage power supply within the case comprising one or more direct current batteries;

(c) a switch in electrical contact with the low-voltage power supply to activate the module;

(d) a light-emitting diode in electrical contact with the switch could the low-voltage power supply operable to produce user visible light;

(e) a means to attach the module in close proximity to or in a hazard area having a potential hazard such that the light is directed towards the area from which personnel are likely to enter the hazard area;

(f) a decal describing the nature of the potential hazard, the decal being attached to the case such that the decal is visible to personnel entering the hazard area; and (g) at least two rectifiers positioned in series between each battery and the switch;

wherein the module is lightweight, portable, and intrinsically-safe;

whereby, when the module is activated, the light-emitting diode emits a user visible light to warn personnel in the area of the potential hazard and direct their attention to the potential hazard.

2. A module as defined in claim 1, wherein the light-emitting diode is a flasher-type.

3. A module as defined in claim 2, wherein the low-voltage power supply contains at least two batteries of about 2 to 10 volts.

4. A module as defined in claim 2, wherein the light-emitting diode flashes at a rate of about 1 to 5 pulses per second.

5. A module as defined in claim 1, wherein the low-voltage power supply contains at least two batteries of about 2 to 10 volts.

6. A module as defined in claim 1, wherein the case is sealed to prevent the entry of water and/or dust into the case.

7. An intrinsically-safe roof hazard ale module for warning personnel of a potential hazard in an underground mine, said module comprising:

(a) a case having side walls, a first end wall, and second end wall wherein the case has an internal cavity formed by the side walls and first and second end walls;

(b) a low-voltage power supply within the case comprising one or more direct current disposable batteries;

(c) a switch in electrical contact with the low-voltage power supply to activate the module;

(d) a flasher-type light-emitting diode in electrical contact with the switch and the low-voltage power supply operable to produce user visible light;

(e) a means to attach the module in close proximity to or in a hazard area having a potential hazard such that the light is directed towards the area from which personnel are likely to enter the hazard area;

(f) a decal describing the nature of the potential hazard, the decal being attached to the case such that the decal is visible to personnel entering the hazard area; and (g) at least two rectifiers positioned in series between each battery and the switch;

wherein the module is lightweight, portable, and intrinsically-safe;

whereby, when the module is activated, the light-emitting diode emits a user visible flashing light to warn personnel in the area of the potential hazard and direct their attention to the potential hazard.

8. A module as defined in claim 7, wherein the attachment means allows the module to be attached to a roof bolt.

9. A module as defined in claim 7, wherein the low-voltage power supply contains batteries of about 2 to 10 volts and wherein the light-emitting diode flashes at a rate of about 1 to 5 pulses per second.

10. A module as defined in claim 9, wherein the case is sealed to prevent the entry of water and/or dust into the case.

11. A hard alert module for warning personnel of a potential hazard in a hazard area, the module comprising:

a case having an interior cavity;

an electrical circuit comprising a low-voltage power supply, at least two rectifiers positioned in series, a resistor, a fuse, a light-emitting diode operable to produce user visible light and a switch;

wherein the rectifiers are operable to limit current flow in one direction, thereby avoiding damage to the light-emitting diode operable to produce user visible light and wherein the resistor limits current flow through the rectifiers; and a decal describing the nature of the potential hazard, the decal being attached to the case such that the decal is visible to personnel entering the hazard area;

wherein the module is intrinsically safe to permit use of the module in an environment containing flammable material.

12. The module as defined in claim 11, wherein the case has an outer wall defining a recess, and an operator for the switch extending through the outer wall and positioned in the recess.

13. The module as defined in claim 11, wherein the case has an outer wall defining a recess, and the light-emitting diode extends through the outer wall and is positioned in the recess.

14. The module as defined in claim 11, further comprising a magnet for magnetically attaching the module to a structure.

15. A hazard alert module for warning personnel of a potential hazard in a hazard area; the module comprising:

a case having an interior cavity and an outer wall defining a first recess;

a low-voltage power supply disposed with the cavity, the power supply comprising one or more direct current batteries;

a switch in electrical contact with the low-voltage power supply to activate the module, the switch being positioned in the recess;

a light-emitting diode in electrical contact with the switch and the low voltage power supply, the light-emitting diode being operable to produce user visible light;

a decal describing the nature of the potential hazard, the decal being attached to the case such that the decal is visible to personnel entering the hazard area; and at least two rectifiers positioned in series between each battery and the switch;

wherein the module is intrinsically safe to permit use of the module in an environment containing flammable material.

16. The module as defined in claim 15, wherein the outer wall further comprises a second recess, the light-emitting diode being positioned in the second recess.

17. The module as defined in claim 15 further comprising a magnet for magnetically attaching the module to a structure.

* * * * *